US008475231B2

(12) United States Patent
Paik et al.

(10) Patent No.: US 8,475,231 B2
(45) Date of Patent: Jul. 2, 2013

(54) CARRIER HEAD MEMBRANE

(75) Inventors: Young J. Paik, Campbell, CA (US); Ashish Bhatnagar, Fremont, CA (US); Kadthala Ramaya Narendrnath, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 865 days.

(21) Appl. No.: 12/631,239

(22) Filed: Dec. 4, 2009

(65) Prior Publication Data

US 2010/0311311 A1 Dec. 9, 2010

Related U.S. Application Data

(60) Provisional application No. 61/122,321, filed on Dec. 12, 2008.

(51) Int. Cl.
*B24B 1/00* (2006.01)
*B24B 5/00* (2006.01)

(52) U.S. Cl.
USPC ..... 451/41; 451/288; 451/398

(58) Field of Classification Search
USPC ..... 451/41, 285–289, 397, 398
See application file for complete search history.

(56) References Cited

U.S. PATENT DOCUMENTS 5,738,574 A 4/1998 Tolles et al.
5,851,140 A * 12/1998 Barns et al. ..... 451/288
6,056,632 A 5/2000 Mitchel et al.
6,162,116 A 12/2000 Zuniga et al.
6,183,354 B1 2/2001 Zuniga et al.
6,210,255 B1 4/2001 Zuniga et al.
6,450,868 B1 9/2002 Zuniga et al.
6,705,932 B1 3/2004 Zuniga et al.
6,855,043 B1 2/2005 Tang et al.
6,857,945 B1 2/2005 Chen et al.
7,101,273 B2 * 9/2006 Tseng et al. ..... 451/288
7,166,019 B2 1/2007 Park et al.
7,198,561 B2 * 4/2007 Chen et al. ..... 451/288
7,727,055 B2 * 6/2010 Zuniga et al. ..... 451/398
7,959,496 B2 * 6/2011 Spiegel ..... 451/59
2002/0182996 A1 12/2002 Zuniga et al.
2004/0242129 A1 12/2004 Boo et al.
2006/0154580 A1 7/2006 Chen et al.
2007/0207709 A1 9/2007 Berkstresser et al.
2008/0014842 A1 1/2008 Berkstresser et al.
2008/0119119 A1 5/2008 Zuniga et al.
2008/0119122 A1 5/2008 Zuniga et al.
2009/0242125 A1 10/2009 Paik et al.

OTHER PUBLICATIONS

Chang Yong Lee, Authorized Officer, Korean Intellectual Property Office, International Search Report and Written Opinion for PCT/US2009/067578 mailed Jul. 15, 2010, 10 pages.

* cited by examiner

*Primary Examiner* — Dung Van Nguyen
(74) *Attorney, Agent, or Firm* — Fish & Richardson P.C.

(57) ABSTRACT

A flexible membrane includes a horizontal central portion, a vertical portion coupled to the central portion, a thick rim portion coupled to the vertical portion, and an extension coupled to the thick rim portion. An outer surface of the horizontal central portion provides a mounting surface configured to receive a substrate. The thick rim portion has a thickness that is greater than a portion directly adjacent to the thick rim portion. The thick rim portion is between the extension and the vertical portion and a greatest dimension of the extension is less than the thickness of the thick rim portion.

16 Claims, 5 Drawing Sheets

CARRIER HEAD MEMBRANE

CROSS-REFERENCE TO RELATED APPLICATIONS

This application claims priority to U.S. Provisional Application Ser. No. 61/122,321, filed on Dec. 12, 2008, the entire contents of which is incorporated by reference.

BACKGROUND

This invention relates generally to chemical mechanical polishing of substrates, and more particularly to a carrier head that includes a flexible membrane for use in chemical mechanical polishing.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface presents problems in the photolithographic steps of the integrated circuit fabrication process. Therefore, there is a need to periodically planarize the substrate surface.

One accepted method of planarization is chemical mechanical polishing (CMP). This planarization method typically requires that the substrate be mounted on a carrier or polishing head. The exposed surface of the substrate is placed against a moving polishing surface, such as a rotating polishing pad. The polishing pad may be either a "standard" polishing pad with a durable roughened surface or a "fixed-abrasive" polishing pad with abrasive particles held in a containment media. The carrier head provides a controllable load to the substrate to push it against the polishing pad. A polishing slurry, including at least one chemically reactive agent, and abrasive particles if a standard pad is used, is supplied to the surface of the polishing pad.

Some carrier heads include a flexible membrane with a mounting surface that receives the substrate. A chamber behind the flexible membrane is pressurized to cause the membrane to expand outwardly and apply the load to the substrate. After polishing, the substrate is chucked to the mounting surface, lifted off the polishing pad, and moved to another location, such as a transfer station or another polishing pad.

SUMMARY

On one aspect, a membrane is described. The membrane is a flexible membrane including a horizontal central portion, a vertical portion coupled to the central portion, a thick rim portion coupled to the vertical portion, and an extension coupled to the thick rim portion. An outer surface of the horizontal central portion provides a mounting surface configured to receive a substrate. The thick rim portion has a thickness that is greater than a portion directly adjacent to the thick rim portion. The thick rim portion is between the extension and the vertical portion and a greatest dimension of the extension is less than the thickness of the thick rim portion.

Implementations of the invention may include one or more of the following features. The membrane can have a connecting portion between the thick rim portion and the vertical portion, wherein the connecting portion is horizontal and parallel to the central portion. A cross section of the connecting portion, vertical portion and central portion can form a u-shape with the thick rim portion at one end of the u-shape.

The thick rim can have a circular cross section. The extension can have a thickness that is less than 50% of the thickness of the thick rim portion. The extension can have a thickness that is less than 25% of the thickness of the thick rim portion. The extension can have a thickness that is less than 15% of the thickness of the thick rim portion. The extension can have a thickness that is less than 10% of the thickness of the thick rim portion. The flexible membrane can be formed of polychloroprene, ethylene propylene diene rubber or silicone. The horizontal central portion can be circular. The horizontal central portion can have a diameter of about 200 mm. The horizontal central portion can have a diameter of about 300 mm. The thick rim portion can have annular and the extension can have annular. The thick rim can have a cross section with a flat portion.

A carrier head for retaining the substrate can include a membrane as described herein, a retaining ring surrounding the membrane and a base assembly connected to the retaining ring, wherein a cavity is between the base assembly and the membrane and the thick rim portion and extension are sealed to a component of the base assembly so that fluid cannot pass between the membrane and component.

Implementations of the invention may include one or more of the following advantages. Membranes can be formed with a sealing portion that may be easy to fit into a recess of a carrier head component and seal to the walls of the recess so that fluid cannot pass between the membrane and component. Because the membrane easily fits into the recess, the membrane may be quickly and easily replaced and the non-operational time of the carrier head may be minimized. Further, because there is a higher probability of forming a membrane that does not leak, fewer membranes will be rejected as unusable, i.e., leaky or non fitting, and less time may be spent replacing rejected membranes. Less downtime for the carrier head may allow for greater manufacturing efficiency.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
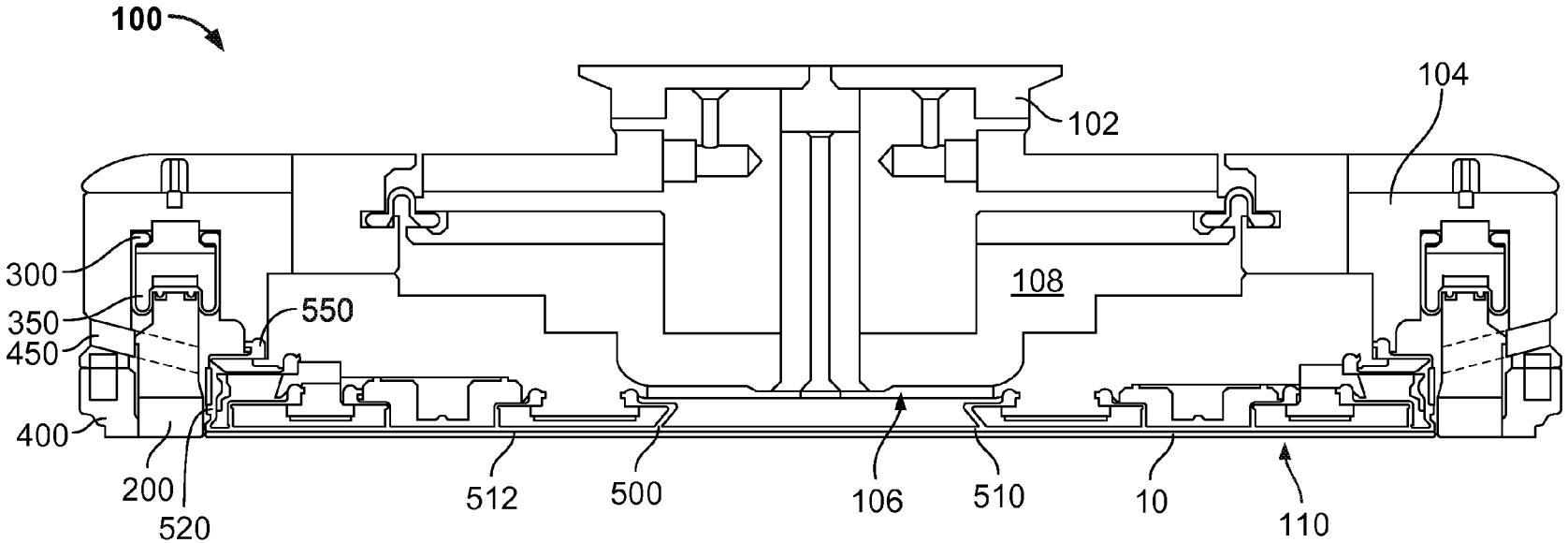
FIG. 1 shows a schematic cross-sectional view of a carrier head according to the present invention.

As noted above, some carrier heads include a flexible membrane that provides a mounting surface for a substrate during and between polishing operations. The flexible membrane, or diaphragm, has a horizontal mounting surface for contacting a backside of the substrate and clamping portions that are on the ends of flaps that extend from the back of the flexible membrane. In some embodiments the clamping portion is annular. The clamping portions are used to connect the membrane to a carrier head. Some types of clamping portions have a thick rim portion or bead at the end of the clamping portion. The thick rim fits into a groove or recess in a support component of the carrier head. Because the thick rim is thicker than other parts of the flap, the flap is not easily pulled out of the recess even when the chamber behind the membrane is pressurized and the membrane flexes out away from the carrier head.

The carrier head is formed of rigid pieces that are fit together. The flexible membrane fits into a component that is more rigid than the membrane. The membrane is sufficiently compliant that when an annular clamping portions is fit into a similarly sized annular recess, no fluid can pass between the membrane and the component. A space, i.e., the chamber, between carrier head and the membrane can be sealed. Sealing a cavity between the membrane and carrier head allows the cavity to be positively or negatively pressurized as required.

One potential problem encountered in manufacturing is the manufacturing tolerances of different parts that are made to fit together in a final product. This may be particularly true of a membrane made of a flexible material. Flexible membranes are consumable products that are formed in greater quantity than the carrier heads. These membranes are replaced as the material wears out, e.g., becomes brittle or damaged. When the flexible membrane is formed, the thick rim at the end of the clamping portion is difficult to form with precision. If the thick rim is not within a desired tolerance, the thick rim may either not fit into the recess in which it is held by the carrier head or may not contact the edges of the recess. In either case, the thick rim may not properly seal the cavity between the carrier head and membrane. Lack of proper sealing allows for leaks and typically is an unusable membrane.

By adding an extension to the thick rim, the dimension of the thick rim can be selected to be either at the target size of slightly smaller. The extension on the thick rim causes the thick rim to act as though it is a thick rim of a larger size in terms of sealing to the support component of the carrier head, while maintaining the ease of fit of a small thick rim. Because the extension has smaller dimensions than the thick rim itself, it can be referred to as a flash. Unlike most types of flash that are formed by manufacturing processes and removed, this flash is designed to be maintained on the membrane and to have uniform dimensions around the circumference of the membrane. Because the flash has an intended purpose in the final product and is designed to have specific dimensions, the flash is referred to as an engineered flash.

Referring to FIG. 1, a substrate 10 will be polished by a chemical mechanical polishing (CMP) apparatus that has a carrier head 100. A description of a CMP apparatus may be found in U.S. Pat. No. 5,738,574 and of a carrier head 100 may be found in U.S. Publication No. 2008/0119119, the entire disclosure of which is incorporated herein by reference.

The carrier head 100 includes a housing 102, a base assembly 104, a gimbal mechanism 106 (which may be considered part of the base assembly 104), a loading chamber 108, a retaining ring assembly including a retaining ring 200 and a first flexible membrane 300 shaped to provide an annular chamber 350, a carrier ring 400, and a substrate backing assembly 110 which includes a second flexible membrane 500 that defines a plurality of pressurizable chambers. Other features of the carrier head described for a similar carrier head may be found in U.S. Patent Application Publication No. 2006/0154580, the entire disclosure of which is incorporated herein by reference.

The housing 102 can generally be circular in shape and can be connected to a drive shaft to rotate therewith during polishing. There may be passages (not illustrated) extending through the housing 102 for pneumatic control of the carrier head 100. The base assembly 104 is a vertically movable assembly located beneath the housing 102. The gimbal mechanism 106 permits the base assembly 104 to gimbal relative to the housing 102 while preventing lateral motion of the base assembly 104 relative to the housing 102. The loading chamber 108 is located between the housing 102 and the base assembly 104 to apply a load, i.e., a downward pressure or weight, to the base assembly 104. The vertical position of the base assembly 104 relative to a polishing pad is also controlled by the loading chamber 108. The substrate backing assembly 110 includes a flexible membrane 500 with a lower surface 512 that can provide a mounting surface for a substrate 10.

A substrate 10 can be held by a retaining ring assembly clamped to a base assembly 104. The retaining ring assembly can be constructed from a retaining ring 200 and the flexible membrane 300. The retaining ring 200 can be positioned beneath the flexible membrane 300 and configured to be secured to the flexible membrane 300.

The retaining ring 200 has an inner surface and a lower surface. The inner surface can be configured to circumferentially surround the edge of the substrate 10 to retain the substrate 10 during polishing. The lower surface of the retaining ring 200 can be brought into contact with a polishing pad (not shown). The retaining ring 200 has an annular upper surface that can have two annular concentric recesses.

While the retaining ring 200 is configured to circumferentially surround the edge of a substrate 10 to retain the substrate, the flexible membrane 500 provides a surface 512 to mount the substrate 10. The flexible membrane 500 has a main portion 510 that provides the substrate-mounting surface 512. Extending from the main portion 510 is a vertically extending portion or outer annular portion 520 that can be clamped between the retaining ring 200 and the base assembly 104. In some embodiments, the vertically extending portion is cylindrical.

A thick rim portion 550 or bead is at a periphery of the membrane 500. In some embodiments, a horizontal intermediate portion or lip bends inward toward a center of the membrane 500 and connects the thick rim 550 portion to the annular portion 520. The thick rim 550 is configured to be secured to the base assembly 104.

Figure 2:
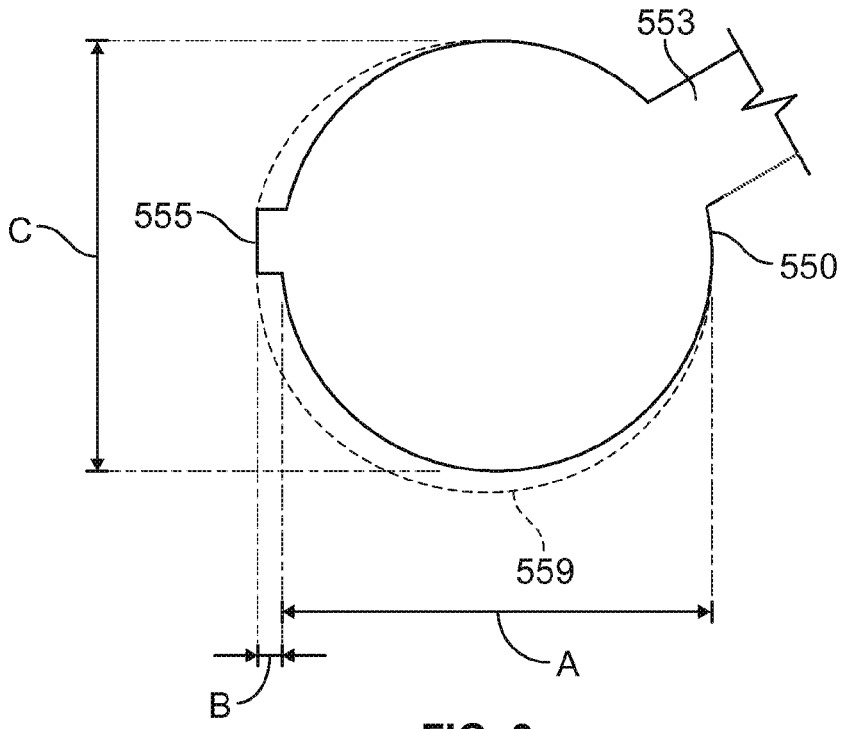
FIG. 2 shows a schematic cross-sectional view of one embodiment of a rim of a membrane.
Figure 3:
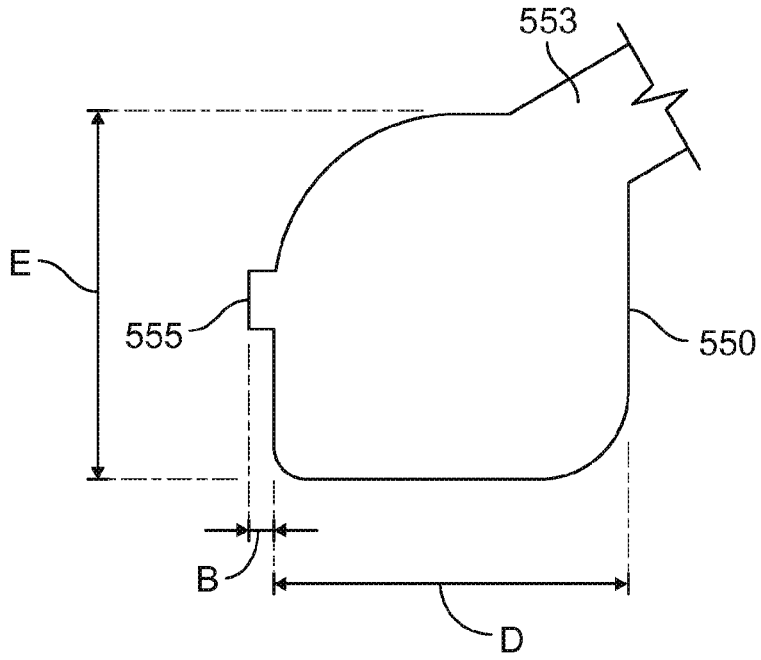
FIG. 3 shows a schematic cross-sectional view of one embodiment of a rim of a membrane.

Referring to FIGS. 2 and 3, a cross-sectional view of the thick rim portion 550 shows the thick rim portion 550 has having a diameter or thickness that is greater than an intermediate portion 553 that is between the thick rim portion 550 and the main portion 510 of the membrane 500. An extending portion 555, or engineered flash, extends away from the thick rim portion 550. That is, the thick rim portion 550 is between the extending portion 555 and the main portion 510. The extending portion 555 causes the effective thickness of the thick rim portion 550 to increase by the thickness of the extending portion 555.

In some embodiments, the thick rim portion 550 has a circular cross section (FIG. 2). The diameter A equals the diameter C of the thick rim portion 550, where the diameter A is measured perpendicular to the diameter C. The thickness B of the extending portion 555 (thickness perpendicular to the surface of the rim portion 550) causes the thick rim portion 550 to seal in a manner of a thick rim portion that has a diameter greater than A, such as the diameter of A+B, but will be less difficult to install than a membrane with a diameter of A+B. For example, the thick rim portion 550 may provide the sealing qualities of a thick rim portion having the dimensions shown in phantom outline 559. The flexibility of the extending portion 555 with diameter B allows the thick rim portion 550 of diameter A plus the extending portion 555 to be forced into a groove or recess that a thick rim portion with a diameter of A+B would not, or would not easily, fit into.

In other embodiments, the thick rim portion 550 has a cross section with curved portions and flat portions (FIG. 3). The widest dimension D in one direction can be greater or less than the widest dimension E in a perpendicular direction to the direction at which dimension D is measured. However, the extending portion 555 behaves in substantially the same way as in the earlier described embodiment. In either a thick rim portion 550 with a circular cross section or a thick rim portion 550 with flat surfaces and curved surfaces, the thickness of the extending portion 555 (perpendicular to the surface of the rim portion 550) is less than a diameter, thickness or widest dimension of the thick rim portion 550, such as less than a radius of thick rim portion 550, such as less than less than 50%, less than 25%, less than 25%, less than 15%, less than 10%, or less than 5% of the thickness or widest dimension of the thick rim portion 550, for example, between 5 and 10% of the radius of the diameter of the thick rim portion 550. In some embodiments, the extending portion 555 has one or more right angles. In some embodiments, the extending portion 555 extends along a radius of the thick rim portion 550 and has sidewalls that are parallel to the radius. In other embodiments, the extending portion 555 tapers as it extends from the thick rim portion 550. In some embodiments, the transition between the thick rim portion 550 and extending portion 555 includes an angle.

The flexible membrane 500 is a generally circular sheet formed of a flexible and elastic material, for example, neoprene, polychloroprene, ethylene propylene diene rubber or silicone. The membrane 500 should be hydrophobic, durable, and chemically inert vis-à-vis the polishing process. The main portion 510 can be dimensioned to accept a 200 mm diameter substrate, e.g., the main portion 510 can be about 200 mm in diameter or slightly larger or can be dimensioned to accept a 300 mm diameter substrate, e.g., the main portion 510 can be about 300 mm in diameter or slightly larger.

Figure 4:
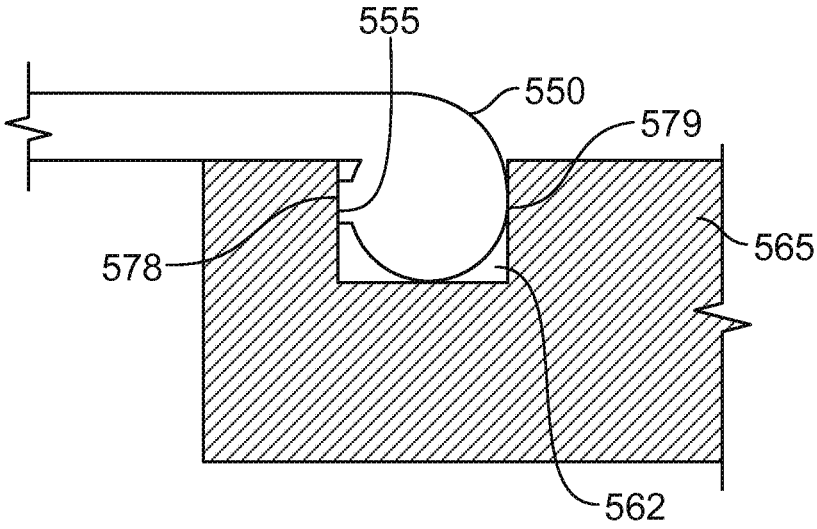
FIGS. 4-5 show a schematic cross-sectional view of a rim of a membrane in a carrier head support component.
Figure 5:
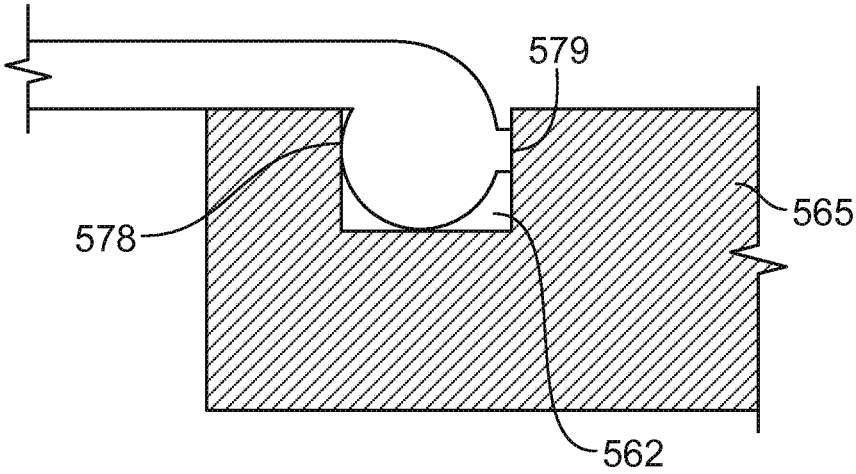

FIGS. 4 and 5 show a partial cross sectional view of the thick rim portion 550 and extending portion 555 in a recess 562 of a support component 565 of the carrier head assembly 104. The thick rim portion 550 contacts the walls of the recess at contact points 578, 579. The extending portion 555 is located on the thick rim portion 550 in the region of the contact points 578. As can be seen from the two figures, the extending portion 555 can be located at either an inner contact point 578, closer to the annular portion 520 or at an outer contact point 579 closer to the center of the membrane 500. In some embodiments, the extending portion 555 is parallel to the plane along in which the intermediate portion 553 is oriented. In some embodiments, the extending portion 555 extends in a direction parallel to a direction that the intermediate portion 553 extends. In some embodiments, the extending portion 555 extends at a 10°, 15°, 30° or 45° angle to the plane along with the intermediate portion 553 extends.

In addition to determining where to locate the extending portion 555, a size of the extending portion 555 can be determined. In some instances, there is a range of diameters that allow the thick rim portion 550 to fit into a recess and simultaneous not allow fluid to lead between the membrane and the support component 565. The range can be from x to y with a median target diameter z. The ends of the range, x and y, are about three standard deviations away from target diameter z. If membranes with a thick rim portion 550 were made with a target diameter of x, due to the imperfections in manufacturing, many of the membranes would leak. If membranes with a thick rim portion 550 were made with a target diameter of y, due to the imperfections in manufacturing, many of the membranes would not fit into the recess. One option is to make the thick rim portion 550 have the diameter z and make the extending portion 555 to have a thickness that is within two standard deviations of the target thickness. This thickness can be approximated by formula $(2*(y-z)/3)$.

Figure 6:
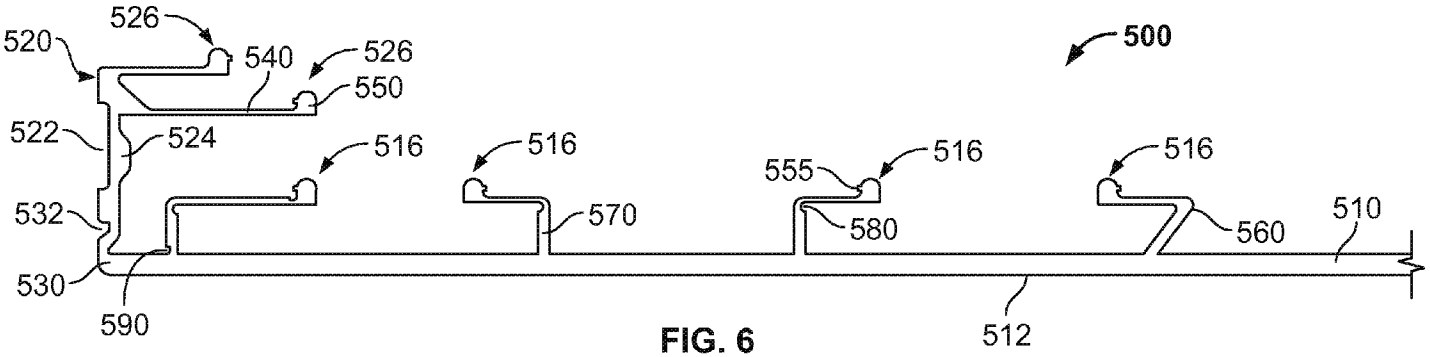
FIG. 6 shows schematic cross-sectional view of a portion of one embodiment of a membrane.

FIG. 6 shows a partial cross-sectional view of one embodiment of a flexible membrane 500, where only one-half of the cross section of the generally symmetric flexible membrane is shown. As shown in FIG. 6, the flexible membrane 500 can have a juncture between the main portion 510 and the outer annular portion 520 that has a peripheral edge hinge 530 and an annular recess 532, located above the hinge 530 along the outer wall of the outer annular portion 520. The peripheral edge hinge 530 can have rounded portions along its inner and outer surfaces. The peripheral edge hinge 530 and the annular recess 532 can be configured to be compliant, improving the symmetry of loading on the periphery of the substrate 10.

The outer annular portion 520 can have an annular recess 522 along its outer wall, which is configured to allow the outer annular portion 520 to flex. The outer annular portion 520 can also have an annular step 524 protruding inwardly along its inner wall. The annular step 524 can have non-horizontal (i.e., sloping) upper and lower surfaces.

In some implementations, the flexible membrane 500 can have several annular flaps. The main portion 510 can have four concentric annular flaps 516. The outer annular portion 520 can have a pair of annular flaps 526. The annular flaps 526 connected to the outer annular portion 520 can have a horizontal portion 540 extending inwardly with a thick rim 550. The horizontal portion 540 connects the thick rim 540 with the annular portion 520. The upper annular flap can have a horizontal portion which is narrower (i.e., does not extend as far inwardly) than the lower annular flap. In some embodiments, the outer annular portion 520 can have an annular triangular portion, and the horizontal portions 540 of the pair of annular flaps 526 can be connected to the outer annular portion 520 through the vertices of the annular triangular portion.

The innermost concentric annular flap 516 connected to the main portion 510 can include a horizontal portion extending outwardly with a thick rim, which can be configured to be secured to a base assembly 104, and an annular angled portion 560. The annular angled portion 560 can be joined between the main portion 510 and the horizontal portion of the annular flap 516. The annular angled portion 560 can have a larger radius at its juncture with the main portion 510 than at its juncture with the horizontal portion.

The three outermost concentric annular flaps 516 connected to the main portion 510 can include a vertical portion 570 extending from the main portion 510, and a horizontal portion extending from the vertical portion 570 with a thick rim along the outer edge of the horizontal portion, which can be configured to be secured to a base assembly 104. In some embodiments, the horizontal portion of a concentric annular flap 516 can have a smaller thickness than the vertical portion 570 of the concentric annular flap. In some implementations, the second and third outermost concentric annular flaps 516 can have a ratio of length of horizontal portion to length of vertical portion 570 between about 1.5 and 2.0, such as about 1.66.

In some implementations, an annular flap 516, 526 can have one or more indentations or notches (i.e., an annular recess). A concentric annular flap 516 can have a notch 580 at the juncture between its horizontal portion and its vertical portion 570. The notch 580 can allow the horizontal portion of the concentric annular flap 516 to flex vertically. A concentric annular flap 516 can have a notch 590 at its juncture with the main portion 510. The notch 590 can be configured to reduce compressions in the main portion 510.

Figure 7:
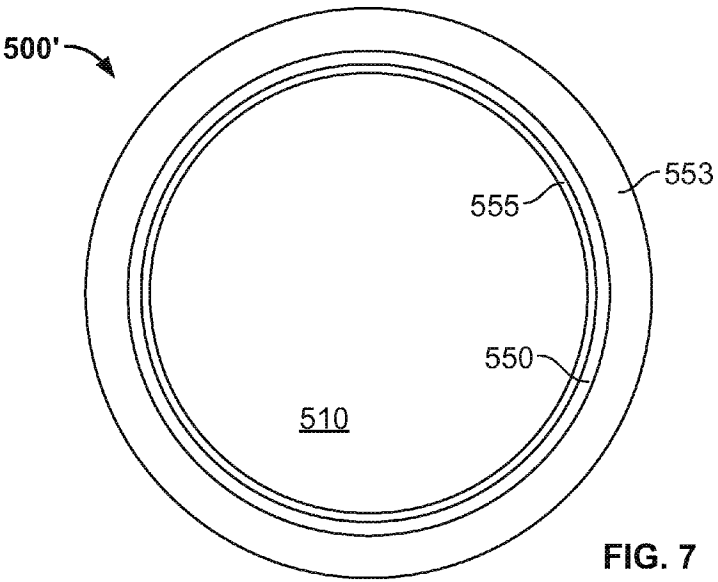
FIG. 7 is a schematic backside view of a membrane.
Figure 8:
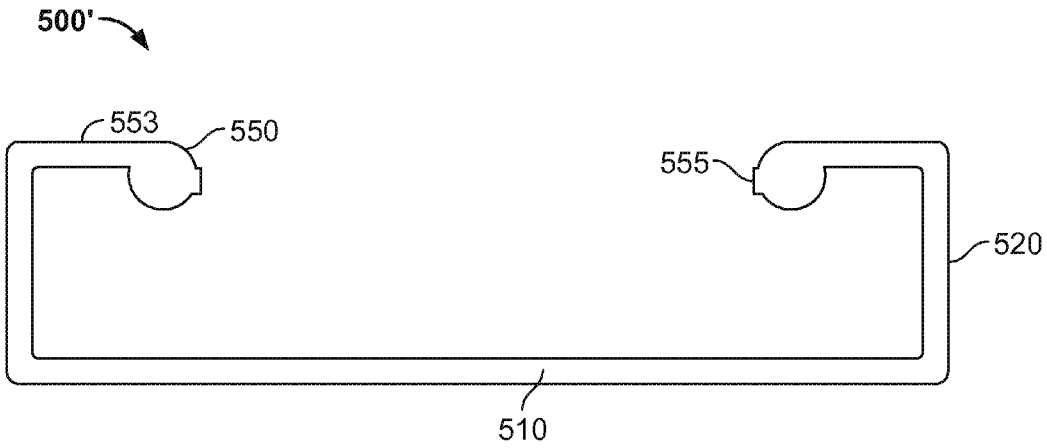
FIG. 8 is a schematic cross-sectional view of an embodiment of a membrane.
Figure 9:
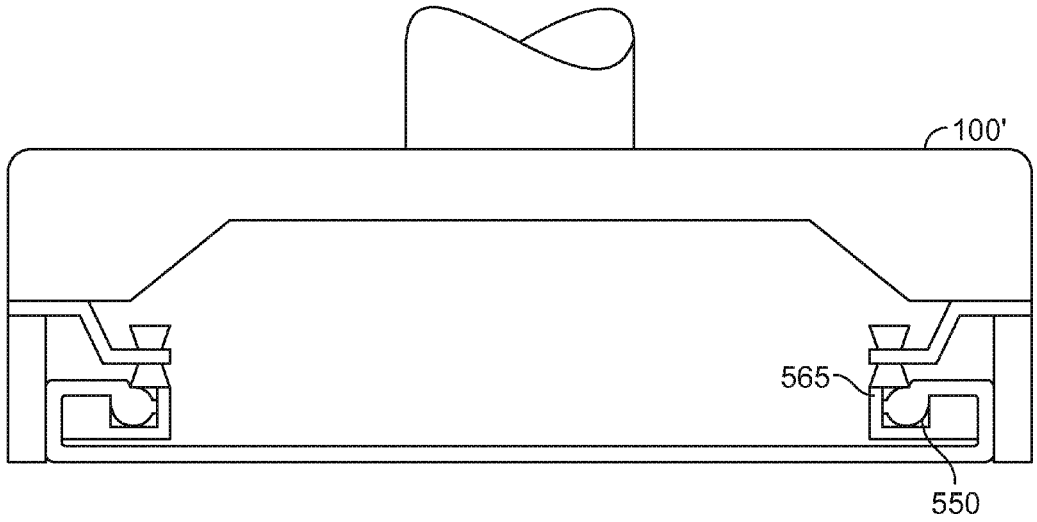
FIG. 9 is a schematic cross-sectional view of a membrane held by a carrier head.

Referring to FIG. 7, in another embodiment, the flexible membrane 500' does not include non-periphery backside flaps. A backside or plan view of the membrane shows an inner surface of the main portion 510, the annular intermediate portion 553, which connects the outer annular portion 520 with the annular thick rim 550. The thick rim 550 is between the annular intermediate portion 553 and the annular extending portion 555. As can be seen in FIG. 8, the outer annular portion 520, which is cylindrical and lacks recesses, is between the circular main portion 510 and the annular intermediate portion 553. FIG. 9 shows a schematic cross-sectional view of the membrane 500' held by a carrier head 100'.

A number of embodiments of the invention have been described. Nevertheless, it will be understood that various modifications may be made without departing from the spirit and scope of the invention. For example, the extending portions 555 can be at a non-parallel angle to the main portion. The features of one membrane described herein can be used with the other membrane described herein. Further, extending portions can be placed on components other than membranes, such as o-rings and the like. Accordingly, other implementations are within the scope of the following claims.

What is claimed is:

1. An article for use in a carrier head, comprising:

a flexible membrane including a horizontal central portion, a vertical portion coupled to the central portion, a thick rim portion coupled to the vertical portion, and an extension coupled to the thick rim portion, an outer surface of the horizontal central portion providing a mounting surface configured to receive a substrate, the thick rim portion having a thickness that is greater than a portion directly adjacent to the thick rim portion, wherein the thick rim portion is between the extension and the vertical portion and a greatest dimension of the extension is less than the thickness of the thick rim portion.

2. The article of claim 1, further comprising a connecting portion between the thick rim portion and the vertical portion, wherein the connecting portion is horizontal and parallel to the central portion.

3. The article of claim 2, wherein a cross section of the connecting portion, vertical portion and central portion form a u-shape with the thick rim portion at one end of the u-shape.

4. The article of claim 1, wherein the thick rim has a circular cross section.

5. The article of claim 1, wherein the extension has a thickness that is less than 50% of the thickness of the thick rim portion.

6. The article of claim 5, wherein the extension has a thickness that is less than 25% of the thickness of the thick rim portion.

7. The article of claim 6, wherein the extension has a thickness that is less than 15% of the thickness of the thick rim portion.

8. The article of claim 5, wherein the extension has a thickness that is less than 10% of the thickness of the thick rim portion.

9. The article of claim 1, wherein the flexible membrane is formed of polychloroprene, ethylene propylene diene rubber or silicone.

10. The article of claim 1, wherein the horizontal central portion is circular.

11. The article of claim 10, wherein the horizontal central portion has a diameter of about 200 mm.

12. The article of claim 10, wherein the horizontal central portion has a diameter of about 300 mm.

13. The article of claim 1, wherein the thick rim portion is annular; and the extension is annular.

14. The article of claim 1, wherein the thick rim has a cross section with a flat portion.

15. A carrier head for retaining the substrate, comprising:

the membrane of claim 1;

a retaining ring surrounding the membrane; and a base assembly connected to the retaining ring, wherein a cavity is between the base assembly and the membrane and the thick rim portion and extension are sealed to a component of the base assembly so that fluid cannot pass between the membrane and component.

16. A method of polishing a substrate, comprising:

applying a load to a substrate with a carrier head, the carrier head comprising:

a retaining ring; and a flexible membrane configured to press the substrate against a polishing pad, the membrane including an inner surface that forms the boundary of a pressurizable chamber and an outer surface providing a substrate receiving surface;

wherein the retaining ring surrounds the flexible membrane, the membrane including a horizontal central portion, a vertical portion coupled to the central portion, a thick rim portion coupled to the vertical portion, and an extension coupled to the thick rim portion, the thick rim portion having a thickness that is greater than a portion directly adjacent to the thick rim portion, wherein the thick rim portion is between the extension and the vertical portion and a greatest dimension of the extension is less than the thickness of the thick rim portion; and creating a relative motion between the substrate and a polishing pad while applying the load.

* * * * *

UNITED STATES PATENT AND TRADEMARK OFFICE

CERTIFICATE OF CORRECTION

PATENT NO. : 8,475,231 B2
APPLICATION NO. : 12/631239
DATED : July 2, 2013
INVENTOR(S) : Young J. Paik, Ashish Bhatnagar and Kadthala Ramaya Narendrnath It is certified that error appears in the above-identified patent and that said Letters Patent is hereby corrected as shown below:

In the Claims:

Column 7, line 40, in Claim 1, after "than" insert -- a thickness of --.

Column 7, line 52, in Claim 4, after "rim" insert -- portion --.

Column 8, linc 23, in Claim 14, after "rim" insert -- portion --.

Column 8, line 26, in Claim 15, replace "membrane" with -- article --.

Column 8, line 35, in Claim 16, replace "to a" with -- to the --.

Column 8, line 40, in Claim 16, before "boundary" replace "the" with -- a --.

Column 8, line 49, in Claim 16, after "than" insert -- a thickness of --.

Column 8, line 54, in Claim 16, after "and" replace "a" with -- the --.

Signed and Sealed this
Third Day of September, 2013

Teresa Stanek Rea

Teresa Stanek Rea
*Acting Director of the United States Patent and Trademark Office*